US006745723B1

(12) United States Patent
Hicks et al.

(10) Patent No.: US 6,745,723 B1
(45) Date of Patent: Jun. 8, 2004

(54) WATER HEATER HEAT TRAP APPARATUS

(75) Inventors: Kenneth J. Hicks, Deatsville, AL (US); David L. Henderson, Millbrook, AL (US); Jozef Boros, Montgomery, AL (US)

(73) Assignee: Rheem Manufacturing Company, New York, NY (US)

( * ) Notice: Subject to any disclaimer, the term of this patent is extended or adjusted under 35 U.S.C. 154(b) by 0 days.

(21) Appl. No.: 10/612,369

(22) Filed: Jul. 2, 2003

(51) Int. Cl.[7] ..... F16K 15/16

(52) U.S. Cl. ..... 122/14.31; 137/855

(58) Field of Search ..... 122/14.31, 13.01, 122/13.3, 14.3; 137/855; 392/452, 453; 138/40, 42, 43, 44

(56) References Cited

U.S. PATENT DOCUMENTS

| | | | | | |
|---|---|---|---|---|---|
| 2,322,631 | A | | 6/1943 | Groeniger | 277/70 |
| 2,912,999 | A | | 11/1959 | Kersh | 137/512.4 |
| 3,115,155 | A | | 12/1963 | Clark | 137/512.3 |
| 4,009,366 | A | | 2/1977 | Danell | 219/208 |
| 4,083,583 | A | | 4/1978 | Volgstadt et al. | 285/55 |
| 4,579,104 | A | * | 4/1986 | Snavely | 122/14.31 |
| 4,756,982 | A | | 7/1988 | McCartney, Jr. | 429/54 |
| 4,930,551 | A | | 6/1990 | Haws | 137/337 |
| 4,964,394 | A | | 10/1990 | Threatt | 126/361 |
| 5,009,391 | A | | 4/1991 | Steigerwald | 251/149.1 |
| 5,117,871 | A | | 6/1992 | Gardner et al. | 137/855 |
| 5,176,652 | A | | 1/1993 | Littrell | 604/167 |
| 5,183,029 | A | | 2/1993 | Ranger | 126/362 |
| 5,277,171 | A | * | 1/1994 | Lannes | 122/14.31 |
| 5,577,491 | A | | 11/1996 | Lewis | 126/362 |
| 5,899,218 | A | | 5/1999 | Dugan | 137/1 |
| 6,089,260 | A | | 7/2000 | Jaworski et al. | 137/512 |
| 6,164,333 | A | * | 12/2000 | Murphy et al. | 137/855 |
| 6,269,780 | B1 | * | 8/2001 | Hughes | 122/14.3 |
| 6,302,063 | B1 | | 10/2001 | Schimmeyer | 122/14.3 |
| 6,370,328 | B1 | | 4/2002 | Mottershead | 392/452 |
| 6,532,906 | B1 | | 3/2003 | Knoeppel et al. | 122/14.3 |
| 6,547,106 | B2 | | 4/2003 | Bonningue | 222/213 |

* cited by examiner

*Primary Examiner*—Gregory Wilson
(74) *Attorney, Agent, or Firm*—Konneker & Smith, P.C.

(57) ABSTRACT

Convective heat traps are installed at the cold water inlet and hot water outlet of a water heater. Each heat trap has a tubular body with two axially spaced apart resilient flapper members transversely extending across the interior of the body and being hinged on opposite sides thereof. The heat trap at the cold water inlet is coaxially disposed within a dip tube. In one alternate structure, flapper members are mounted directly on the dip tube, and in another alternate structure an external annular seal element is mounted on the dip tube or heat trap body, with a flapper member being integrally formed with the seal element.

29 Claims, 3 Drawing Sheets

WATER HEATER HEAT TRAP APPARATUS

BACKGROUND OF THE INVENTION

The present invention generally relates to water flow control apparatus and, in illustrated embodiments thereof, more particularly relates to specially designed water heater convective heat trap constructions.

Water heaters of both the fuel-fired and electrically heated types typically have a tank portion in which pressurized, heated water is stored for on-demand delivery to various types of hot water-utilizing plumbing fixtures such as, for example, sinks, bath tubs and dishwashers. During standby periods in which discharge of stored hot water from the tank is not required, it is desirable to substantially reduce heat loss from the stored hot water to cooler areas outside the tank. For this reason it is customary practice to externally insulate the tank.

While this technique is effective in reducing undesirable heat loss from the tank body, stored water heat may also be lost by thermal convection flow of heated water from the tank through its cold water inlet and hot water outlet openings to piping connected thereto. In order to minimize this convective heat loss, various convective heat trap devices have been previously proposed for connection to the tank at or adjacent these inlet and outlet openings. These heat trap devices are basically check valve-type structures which freely permit water to flow through the tank inlet and outlet in operational directions during water supply periods, but substantially inhibit convective water outflow through the inlet and outlet during non-demand storage periods of the water heater.

One common type of convective heat trap utilizes a movable ball to block or impede undesirable convective water flow through its associated water inlet or outlet opening in the tank. While this ball type of heat trap typically eliminates or at least substantially reduces outward convective water flow, it also is prone to create undesirable noise (namely, "rattling") during its operation. This has led to many complaints from water heater purchasers over the Years and corresponding repair or replacement costs for water heater manufacturers.

In response to this well-known problem typically associated with ball-type heat traps various "flapper" type heat trap constructions have been previously proposed as alternatives to movable ball-type heat traps. In this design, a flexible blocking member (or "flapper") is appropriately positioned in each path of potential convective outflow currents of water from the tank (i.e., at or adjacent the cold water inlet and hot water outlet of the tank) and serves as a barrier to undesirable convective outflows of heated tank water during non-demand periods of the water heater. However, when one or more of the plumbing fixtures connected to the water heater is operated to draw hot water from the tank, the flappers resiliently deflect to freely permit cold water supply to the tank and hot water discharge from the tank. Because of the resilient nature of the flappers their operation is typically silent.

However, compared to ball type heat traps flapper type convective heat traps present their own types of problems, limitations and disadvantages including potentially higher cost and greater complexity, installation difficulties, additional shipping volume and less than optimal reductions in convective heat loss from their associated water heater. A need accordingly exists for improved water heater convective heat trap designs. it is to this need that the present invention is directed.

SUMMARY OF THE INVENTION

In carrying out principles of the present invention, in accordance with an illustrated embodiment thereof, a water heater is provided which includes a tank adapted to store a quantity of water and having water inlet and outlet openings; heating apparatus for heating water stored within the tank; and first and second specially designed heat traps respectively associated with the water inlet and outlet openings and operative to inhibit convective water outflows therethrough.

Each heat trap includes a tubular body extending along an axis; and first and second axially spaced apart resilient flapper structures carried by the body and having axially deflectable portions transversely extending across the interior of the body. Preferably, the deflectable flapper structure portions in each heat trap body are axially deflectable about circumferentially offset hinge locations adjacent the interior side surface of the body. Representatively, the hinge locations are circumferentially offset from one another by about 180 degrees. Additionally, when the resilient flapper portions are in undeflected orientations within their associated heat trap body they preferably define circumferentially extending gaps with the interior side surface of the body.

In an illustrated embodiment of the heat traps, each tubular body representatively has an outwardly projecting integral end flange with a noncircular driving recess formed in an outer side thereof. Axially spaced exterior annular grooves are formed in the body side wall, with circumferentially offset slots extending radially through the body at such grooves. Each resilient flapper member has a circular outer ring portion received in one of the grooves, and a generally circular interior portion received within the interior of the body and connected to the ring by a hinge tab portion extending outwardly through the associated slot and being formed integrally with the outer ring.

The heat trap at the cold water inlet of the tank is coaxially received in an upper end portion of a cold water inlet dip tube extending downwardly into the interior of the tank. Alternatively, the tubular body of the heat trap at the cold water inlet of the tank is eliminated, and the flapper members are incorporated directly into the dip tube to form a combination dip tube/heat trap structure.

Representatively, tubular connection spuds are externally secured to the tank over its cold water inlet and hot water outlet openings, and dip cup members extend downwardly through these openings. Tubular seal members circumscribe the hot water side heat trap body and the dip tube and sealingly engage the associated spuds and dip cups. Illustratively, these external seal structures are separate elements, but may alternately be formed integrally with the internal flapper portions. The non circular driving recesses in the flange portions of the heat traps are used to thread the flange edges into threaded interior portions of the connection spuds.

The specially designed neat traps substantially inhibit undesirable convective water flow outwardly through the cold water and hot water tank openings, with the circumferentially offset, axially spaced interior flapper portions forcing tank water to take a generally serpentine path outwardly through the traps. The heat traps operate very quietly, are of a simple construction, are easy to install, are inexpensive to manufacture, and operate in a reliable manner to materially reduce undesirable convective outflow of water from the tank during standby periods of the water heater.

DETAILED DESCRIPTION

Figure 1:
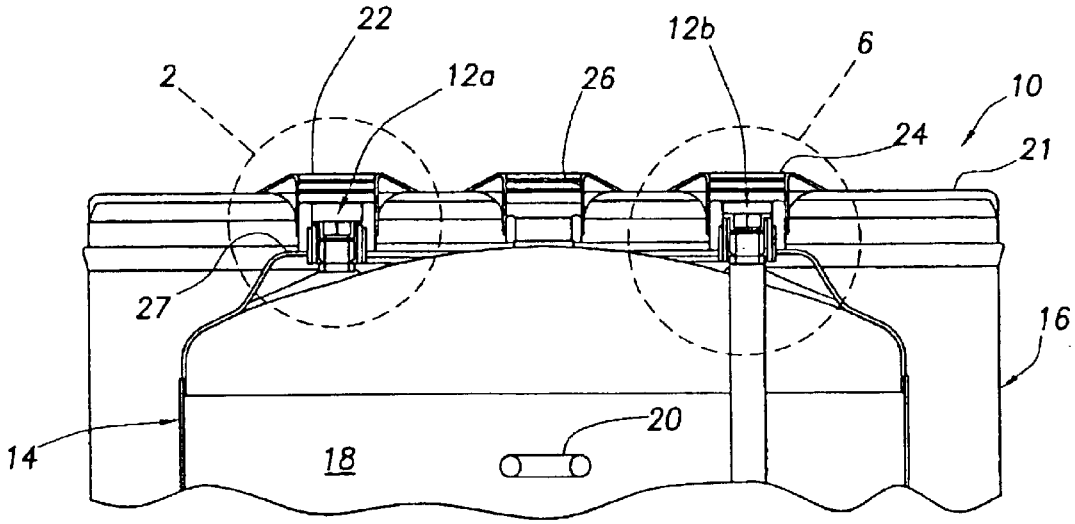
FIG. 1 is a simplified, somewhat schematic cross-sectional view through an upper end portion of a representative water heater in which specially designed convective heat traps embodying principles of the present invention have been installed.

Cross-sectionally depicted in somewhat schematic form in FIG. 1 is a top end portion of a representative water heater 10 in which specially designed convective heat traps 12*a*, 12*b* embodying principles of the present invention are incorporated. Water heater 10 is representatively an electric water heater, but could alternatively be a fuel-fired water heater without departing from principles of the present invention, and includes a water storage tank 14 surrounded by an outer insulated jacket structure 16 of conventional construction. Pressurized water 18 stored in the tank 14 is heated by one or more immersion type electrical resistance heating elements 20 extending through the water 18 in the tank 14.

Figure 2:
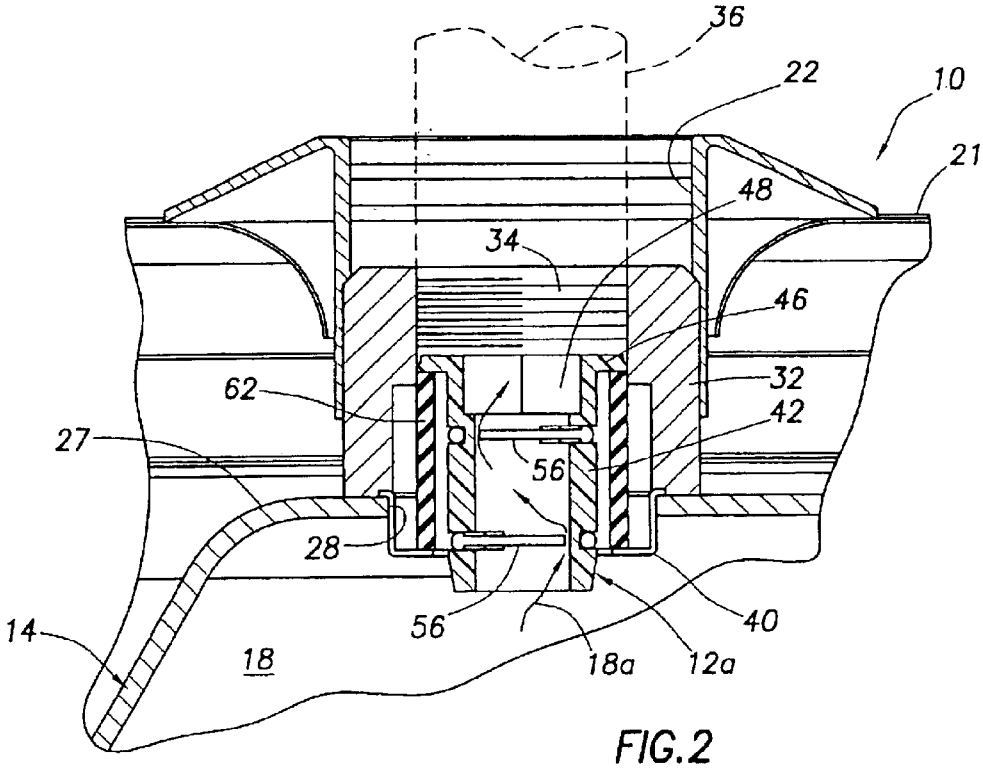
FIG. 2 is an enlarged scale detail view of the dashed circle area "2" in FIG. 1 and illustrates one of the heat traps installed at the hot water outlet of the water heater.
Figure 3:
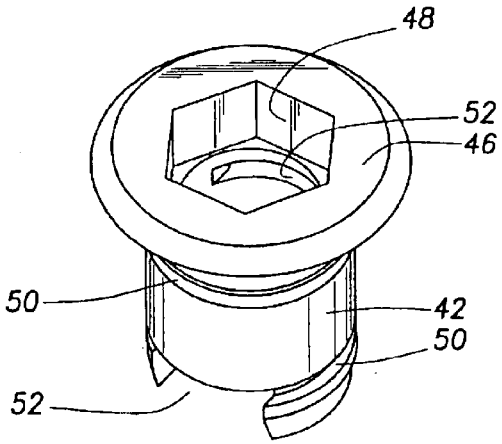
FIG. 3 is a perspective view of a tubular body portion of the FIG. 1 heat trap with associated flapper members removed therefrom.
Figure 4:
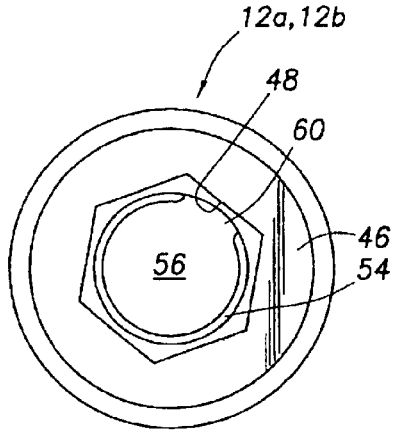
FIG. 4 is a top end view of the heat trap with the flapper members operatively installed therein.
Figure 6:
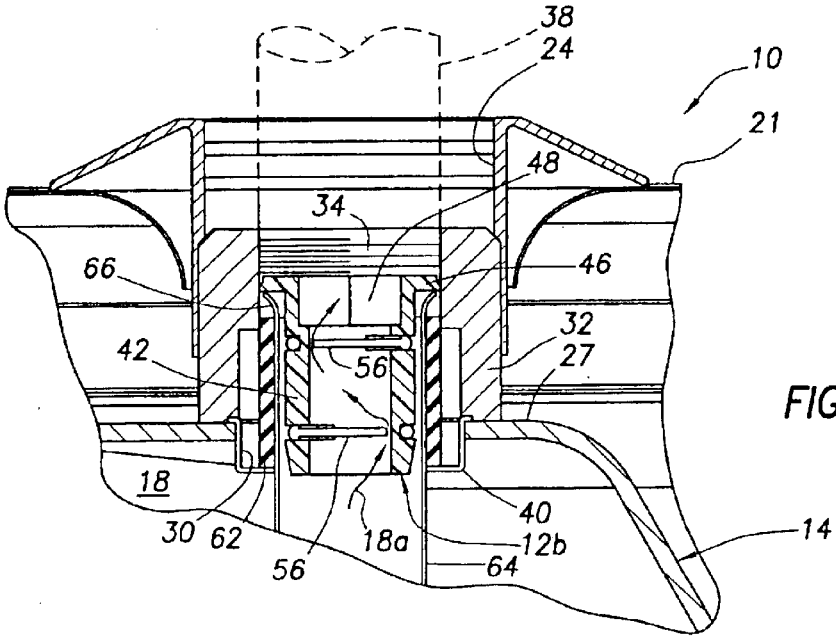
FIG. 6 is an enlarged scale detail view of the dashed circle area "6" in FIG. 1 and illustrates another heat trap operatively installed in a dip tube at the cold water inlet opening of the water heater.

With reference now to FIGS. 1, 2 and 6, the upper end 21 of the outer wall portion of the jacket structure 16 has formed therein a hot water outlet opening 22, a cold water inlet opening 24, and a temperature and pressure relief opening 26. Formed through the top end 27 of the tank 14, and respectively underlying the openings 22 and 24, are a hot water outlet opening 28 and a cold water inlet opening 30. A temperature and pressure relief opening (not shown) is also formed through the upper tank end wall and underlies the jacket opening 26.

As best illustrated in FIGS. 2 and 6, tubular metal pipe connection spuds 32 have lower ends welded to the upper tank end wall 27, over the hot and cold water openings 28,30 therein, and have threaded upper interior end portions 34 thereon into which hot and cold water pipes 36,38 (shown in phantom in FIGS. 2 and 6) may be threaded. Coaxially supported at the hot and cold water tank openings 28,30, and projecting downwardly therefrom into the interior of the tank 14, are annular support cup members 40.

Referring now to FIGS. 2–6, the heat traps 12*a*,12*b* are identical to one another with each heat trap having a tubular body 42, representatively of a molded plastic construction, and a pair of circular flapper members 44 having flat configurations and formed from a resiliently deflectable material, representatively a suitable elastomeric material.

Tubular body 42 has an outwardly projecting circular top end flange 46 (see FIGS. 3 and 4) with a hexagonally shaped driving recess 48 extending downwardly through its top side and communicating with the interior of the body 42. on its exterior side surface the tubular body has two axially spaced apart annular grooves 50. Each groove 50 has a radial slot 52 (see FIG. 3) extending inwardly therethrough to the interior of the body 42. Preferably, the slots 52 are circumferentially offset from one another, illustratively by 180 degrees.

Figure 5:
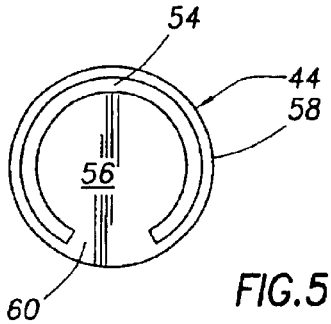
FIG. 5 is a side view of one of the flapper members removed from the heat trap.

As best illustrated in FIG. 5, each flapper member 44 has a partially circular slot 54 formed therein adjacent its periphery. Slot 54 defines in the flapper member 44 a generally circular interior portion 56 joined to a circular outer rim portion 58 by a pivot tab section or hinge section 60. Each of the heat traps 12*a*,12*b* is assembled by inserting the interior portions 56 of two flapper members 44 inwardly through the body slots 52 and then snapping the two rim portions 58 into the two outer side surface grooves 50 of the tubular heat trap body 42. As cross-sectionally illustrated in FIGS. 2 and 6, in each of the heat traps 12*a*,12*b* this positions the interior portions 56 of its two flapper members 44 within axially spaced apart interior portions of the tubular body 42, with the two interior flapper member portions 56 being hinged at locations within the body 42 circumferentially spaced apart from one another by 180 degrees.

To install the heat trap 12*a* at the tank hot water outlet opening 28 (see FIG. 2), an annular resilient seal member 62 is first inserted downwardly through the spud 32 so that the inserted seal member 62 bears against the lower end of the support cup member 40. Next, the heat trap 12*a* is screwed into the spud 32 using a suitable tool inserted into the hex recess area 48 of the heat trap body 42 to rotationally drive the body 42 in a manner causing the outer edge of its flange portion 46 to thread into the threaded interior portion 34 of the spud 32. When the heat trap 12*a* is installed as shown in FIG. 2, the lower end of the heat trap body 42 projects downwardly through the open lower end of the support cup member 40, with the upper and lower ends of the seal member 62 respectively and sealingly engaging the bottom side surface of the flange 46 and the lower end of the support cup member 40 as shown in FIG. 2. The pipe 36 may then be threaded into the spud 32 as shown.

To install the heat trap 12*b* at the tank cold water inlet opening 30 (see FIG. 6), an annular resilient seal member 62 is first installed in the spud 32 as previously described, and an elongated tubular dip tube member 64 is inserted downwardly through the seal member 62 until the dip tube 64 extends downwardly through the open lower end of the support cup member 40 into the interior of the tank 14, and an upper end flange 66 on the dip tube 64 engages the top end of the installed seal member 62. Next, the heat trap 12*b* is threaded downwardly into the spud 32 as previously described until the heat trap enters the interior of a top end portion of the dip tube 64 and the heat trap body flange 46 downwardly engages the dip tube flange 66 as shown in FIG. 6. Finally, the pipe 38 is threaded into the spud 32.

During standby periods of the water heater 10, the interior portions 56 of the heat trap flapper members 44 substantially inhibit upward convective flows of heated water 18 upwardly through their associated heat traps 12*a*,12*b*. Specifically, at the tank hot water outlet opening 28 (See FIG. 2), during standby periods of the water heater 10 convective flow 18*a* of heated water 18 is forced to traverse a generally serpentine path past the oppositely facing outer edges of the oppositely hinged flapper member interior portions 56. However, during drawdown periods of the water heater 10 (i.e., when cold water is entering the tank 14 and hot water is being discharged therefrom), the outgoing hot water 18 upwardly traversing the pipe 36 simply bends the flapper member interior portions 56 upwardly so that they provide only insignificant resistance to hot water outflow through the heat trap 12*a*.

In a similar fashion, at the tank cold water inlet opening 30 (see FIG. 6), during standby periods of the water heater 10 convective flow 18*a* of heated water 18 is forced to traverse a generally serpentine path past the oppositely facing outer edges of the oppositely hinged flapper member interior portions 56. However, during drawdown periods of the water heater 10 the incoming cold water downwardly traversing the pipe 38 simply bends the flapper member interior portions 56 downwardly so that they provide only insignificant resistance to cold water inflow through the heat trap 12*b*.

Figure 7:
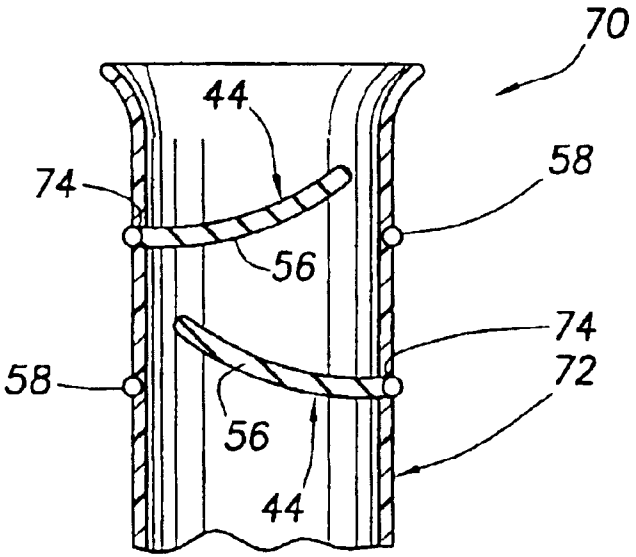
FIG. 7 is a simplified, somewhat schematic cross-sectional view through a dip tube in which an axially spaced pair of flapper members are directly installed.

As previously described, at the cold water inlet portion of the representative water heater 10 separate heat trap and dip tube structures are utilized. in FIG. 7 an alternate combination dip tub/heat trap structure 70 is schematically illustrated in cross-section and includes a cold water inlet dip tube 72 (only an upper end portion of which is shown) and a convective heat trap integrally formed therewith. The integral heat trap is defined by two of the previously described circular flapper members 40, the interior portions 56 of which are inserted through longitudinally spaced apart, circumferentially opposite slots 74 formed through the tubular body of the dip tube 72. The circular outer rim portions 58 of the flapper members 44 may be snapped into suitable exterior annular grooves formed in the body of the dip tube 72. AS illustrated, the interior portions 56 of the two axially spaced flapper members 44 are pivoted on opposite internal sides of the dip tube 72 to form the generally serpentined outlet path for upwardly directed convective heated water currents previously described herein.

Figure 8:
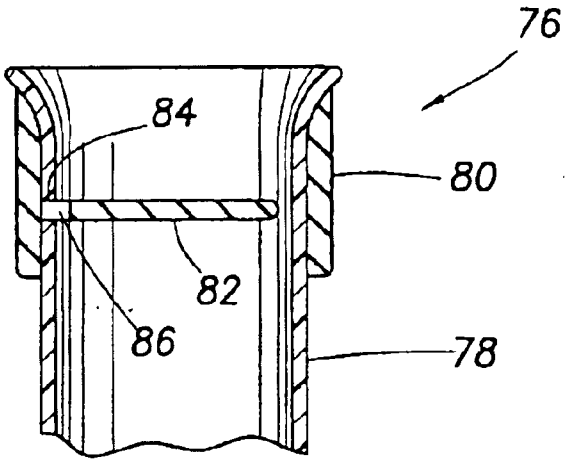
FIG. 8 is a simplified, somewhat schematic cross-sectional view through an alternate embodiment of the FIG. 7 dip tube structure incorporating therein a combination tubular exterior seal element and interior flapper member which formed integrally with the seal element.

Schematically depicted in cross-sectional form in FIG. 8 is a further alternate heat trap embodiment 76 which also embodies principles of the present invention and includes a tubular body 78 (which could be a dip tube) having attached thereto a combination seal/flapper structure defined by an annular resilient seal member 80 outwardly circumscribing the body 78 and a circular flapper member 82 formed integrally with the seal member 80 and extending transversely into the interior Of the tubular body 78 through a suitable side wall slot 84 in the body 78 and being connected to the seal member 80 by a hinge tab portion 86. To provide the heat trap 76 with axially spaced apart flapper structures within the tube 78, another combination seal/flapper structure 80,82 can be secured to the tube 78 below the illustrated seal/flapper structure 80,82. As will be appreciated, the heat trap 76 may be substituted for any of the previously described heat trap structures if desired, with the integral seal member 80 replacing the separate external seal structures.

The foregoing detailed description is to be clearly understood as being given by way of Illustration and example only, the spirit and scope of the present invention being limited solely by the appended claims.

What is claimed is:

1. Convective heat trap apparatus comprising:

a tubular body extending along an axis; and first and second axially spaced apart resilient flapper structures carried by said body and having portions transversely extending across the interior of said body and being operative to inhibit convective fluid flow therethrough, said flapper structure portions being axially deflectable about circumferentially offset hinge locations adjacent the interior side surface of said body.

2. The convective heat trap apparatus of claim 1 wherein:

said hinge locations are circumferentially offset from one another by an angle of about 180 degrees.

3. The convective heat trap apparatus of claim 1 wherein:

said resilient flapper structure portions, when in undeflected orientations, define circumferentially extending gaps between said flapper structure portions and the interior side surface of said tubular body.

4. The convective heat trap apparatus of claim 1 wherein:

said tubular body has an outwardly projecting end flange portion with a noncircular rotational driving structure formed on an outer side thereof.

5. The convective heat trap apparatus of claim 4 wherein:

said noncircular driving structure formed on said end flange is a noncircular driving recess formed in said outer side of said end flange.

6. The convective heat trap apparatus of claim 5 wherein:

said outwardly projecting end flange portion is integrally formed with the balance of said tubular body.

7. The convective heat apparatus of claim 1 wherein:

said tubular body is a cold water inlet dip tube for a water heater.

8. The convective heat trap apparatus of claim 1 wherein:

said apparatus further comprises a cold water inlet dip tube for a water heater, said dip tube having an upper end portion coaxially receiving said tubular body.

9. The convective heat trap apparatus of claim 1 wherein:

said tubular body has axially spaced apart first and second annular exterior side surface grooves circumscribing said axis, and circumferentially spaced slots respectively extending radially inwardly through said first and second grooves into the interior of said tubular body, and each resilient flapper structure has an annular outer ring portion received in one of said first and second grooves, and an interior, resiliently deflectable central portion transversely extending across the interior of said tubular body and joined to an associated outer ring portion by a tab portion extending through one of said slots.

10. The convective heat trap apparatus of claim 1 wherein:

said convective heat trap apparatus is a water heater heat trap.

11. Convective heat trap apparatus comprising:

a tubular body extending along an axis; and first and second axially spaced apart resilient flapper structures carried by said body and having portions transversely extending across the interior of said body and being operative to inhibit convective fluid flow therethrough, said resilient flapper structure portions, when in undeflected orientations, defining axially spaced apart, circumferentially extending first and second gaps between said flapper structure portions and the interior side surface of said tubular body, said first and second gaps being circumferentially offset from one another.

12. The convective heat trap apparatus of claim 11 wherein:

said convective heat trap apparatus is a water heater heat trap.

13. Convective heat trap apparatus comprising:

a tubular body having a slot extending radially inwardly through a side wall portion thereof into its interior;

a generally tubular exterior resilient seal coaxially extending around said tubular body over said slot; and a resilient flapper structure transversely extending across the interior of said body and being connected to said seal through said slot, said resilient flapper structure having a flat configuration with an axial thickness substantially less than the axial length of said seal.

14. The convective heat trap apparatus of claim 13 wherein:

said convective heat trap apparatus is a water heater heat trap.

15. A water heater comprising:

a tank adapted to store a quantity of water and having water inlet and outlet openings;

heating apparatus for heating water stored within said tank; and first and second heat traps respectively associated with said water inlet and outlet openings and operative to inhibit convective water outflows therethrough, each of said first and second heat traps including:

a tubular body extending along an axis, and first and second axially spaced apart resilient flapper structures carried by said body and having portions transversely extending across the interior of said body, said flapper structure portions being axially deflectable about circumferentially offset hinge locations adjacent the interior side surface of said body.

16. The water heater of claim 15 wherein:

said hinge locations in each of said first and second heat traps are circumferentially offset from another by an angle of about 180 degrees.

17. The water heater of claim 15 wherein:

said resilient flapper portions, when in undeflected orientations, define circumferentially extending gaps between said resilient flapper portions and the interior side surface of their associated tubular body.

18. The water heater of claim 15 wherein:

each of said tubular bodies has an outwardly projecting end flange portion with a noncircular rotational driving structure formed on an outer side thereof.

19. The water heater of claim 18 wherein:

said noncircular driving structure formed on said end flange is a noncircular driving recess formed in said outer side of said end flange.

20. The water heater of claim 19 wherein:

said outwardly projecting end flange portion is integrally formed with the balance of said tubular body.

21. The water heater of claim 15 wherein:

one of said tubular bodies is a cold water inlet dip tube.

22. The water heater of claim 15 wherein:

said water heater further comprises a cold water inlet dip tube extending inwardly through said water inlet opening, and said first heat trap is coaxially received in said cold water inlet dip tube.

23. The water heater of claim 15 wherein:

each tubular body has axially spaced apart first and second annular exterior side surface grooves circumscribing said axis, and circumferentially spaced slots respectively extending radially inwardly through said first and second grooves into the interior of said tubular body, and each resilient flapper structure has an annular outer ring portion received in one of said first and second grooves, and an interior, resiliently deflectable central portion transversely extending across the interior of said tubular body and joined to an associated outer ring portion by a tab portion extending through one of said slots.

24. The water heater of claim 15 wherein:

said water heater further comprises connection spuds externally connected to said tank at said water inlet and outlet openings, support cup members extending inwardly through said water inlet and outlet openings, and tubular seal members outwardly circumscribing said first and second heat traps and sealingly engaging their associated connection spuds and support cup members.

25. The water heater of claim 24 wherein:

said tubular bodies have flange portions threaded into said connection spuds.

26. A water heater comprising:

a tank adapted to store a quantity of water and having water inlet and outlet openings;

heating apparatus for heating water stored within said tank; and first and second heat traps respectively associated with said water inlet and outlet openings and operative to inhibit convective water outflows therethrough, each of said first and second heat traps including:

a tubular body extending along an axis, and first and second axially spaced apart resilient flapper structures carried by said body and having portions transversely extending across the interior of said body, said flapper structure portions being axially deflectable relative to said tubular body and, when in an undeflected orientation, defining axially spaced apart, circumferentially extending first and second gaps between said flapper structure portions and the interior side surfaces of their associated tubular bodies, said first and second gaps being circumferentially offset from one another.

27. The water heater of claim 26 wherein:

said water heater further comprises connection spuds externally connected to said tank at said water inlet and outlet openings, support cup members extending inwardly through said water inlet and outlet openings, and tubular seal members outwardly circumscribing said first and second heat traps and sealingly engaging their associated connection spuds and support cup members.

28. The water heater of claim 27 wherein:

said tubular bodies have flange portions threaded into said connection spuds.

29. A water heater comprising:

a tank adapted to store a quantity of water and having a water flow opening therein;

heating apparatus for heating water stored within said tank; and a convective heat trap associated with said water flow opening and including:

a tubular body having a slot extending radially inwardly through a side wall portion thereof into its interior;

a generally tubular exterior resilient seal coaxially extending around said tubular body over said slot; and a resilient flapper structure transversely extending across the interior of said body and being connected to said seal through said slot, said resilient flapper structure having a flat configuration with an axial thickness substantially less than the axial length of said seal.

* * * * *